US005161878A

United States Patent [19]

Degelmann et al.

[11] Patent Number: 5,161,878

[45] Date of Patent: Nov. 10, 1992

[54] LIGHTING FIXTURE FOR USE IN SUSPENDED CEILINGS

[75] Inventors: Paul G. Degelmann, Americus; Danny S. Cape, Hawkinsville, both of Ga.

[73] Assignee: Cooper Industries, Inc., Houston, Tex.

[21] Appl. No.: 830,297

[22] Filed: Jan. 31, 1992

[51] Int. Cl.[5] ..... F21S 3/02

[52] U.S. Cl. ..... 362/150; 362/220; 362/366

[58] Field of Search ..... 362/220, 223, 150, 364, 362/365, 366, 404

[56] References Cited

U.S. PATENT DOCUMENTS

| | | | |
|---|---|---|---|
| 2,680,192 | 6/1954 | Webb | 362/366 |
| 2,802,933 | 8/1957 | Broadwin | 362/366 |
| 2,948,807 | 8/1960 | Maciel, Jr. et al. | 362/366 |
| 2,973,177 | 2/1961 | Stubbs | 362/366 X |
| 3,051,430 | 8/1962 | Halfaker | 362/366 X |
| 3,081,398 | 3/1963 | Karth | 362/150 |
| 3,313,931 | 4/1967 | Klugman | 362/366 |
| 3,316,399 | 4/1967 | Totten | 362/366 |
| 3,488,487 | 1/1970 | Dalton, Jr. | 362/147 |
| 3,697,742 | 10/1972 | Bobrick | 362/366 |
| 4,293,895 | 10/1981 | Kristofek | 362/147 |
| 4,716,504 | 12/1987 | Dahl et al. | 362/150 |
| 4,860,180 | 8/1989 | Degelmann | 362/150 |

*Primary Examiner*—Stephen F. Husar

*Attorney, Agent, or Firm*—Burns, Doane, Swecker & Mathis

[57] ABSTRACT

A lighting fixture is convertible for selective use in different suspended ceilings having grid members with bearing surfaces of a predetermined height differential. The fixture comprises a housing including a main section and two longitudinal side sections releasably securable to the main section. The main section carries a fluorescent lamp(s), and the side sections carry a shielding media, such as a deep cell louver assembly or a luminous element. The side sections carry tabs which are selectively insertable within either of two vertically spaced rows of slots in the main section to enable the main section (and the lamp) to be vertically adjusted relative to the side sections (and the shielding media) in order to maintain a prescribed photometric relationship between the lamp and shielding media, regardless of which grid suspension system is utilized.

16 Claims, 5 Drawing Sheets

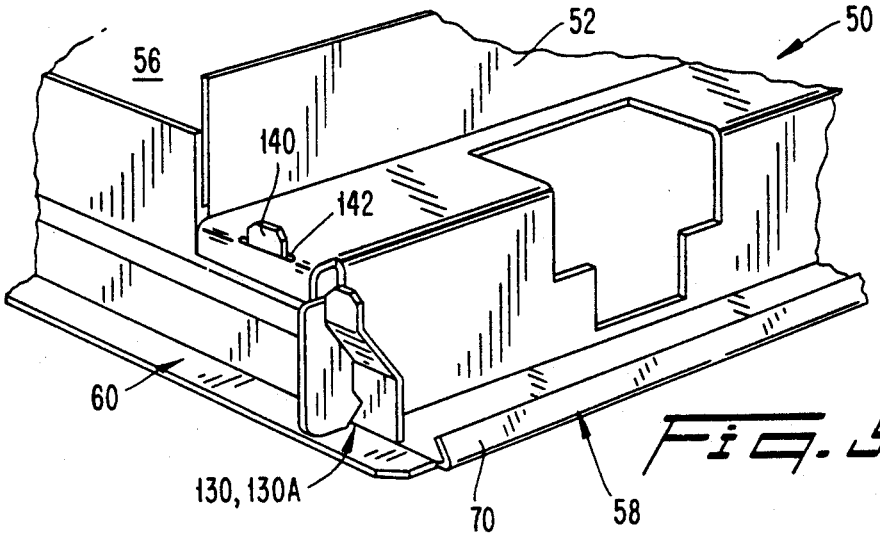
Fig. 5
Fig. 6
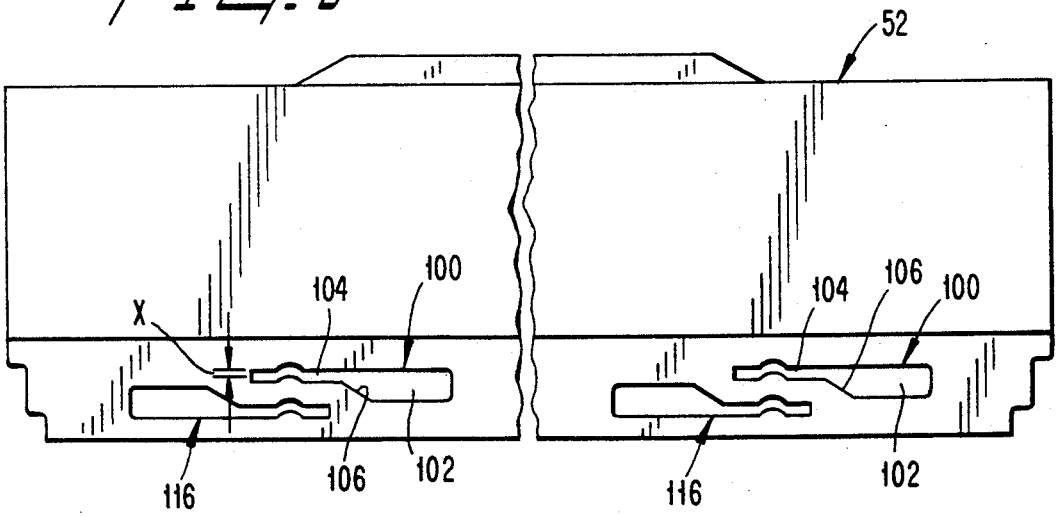
Fig. 7
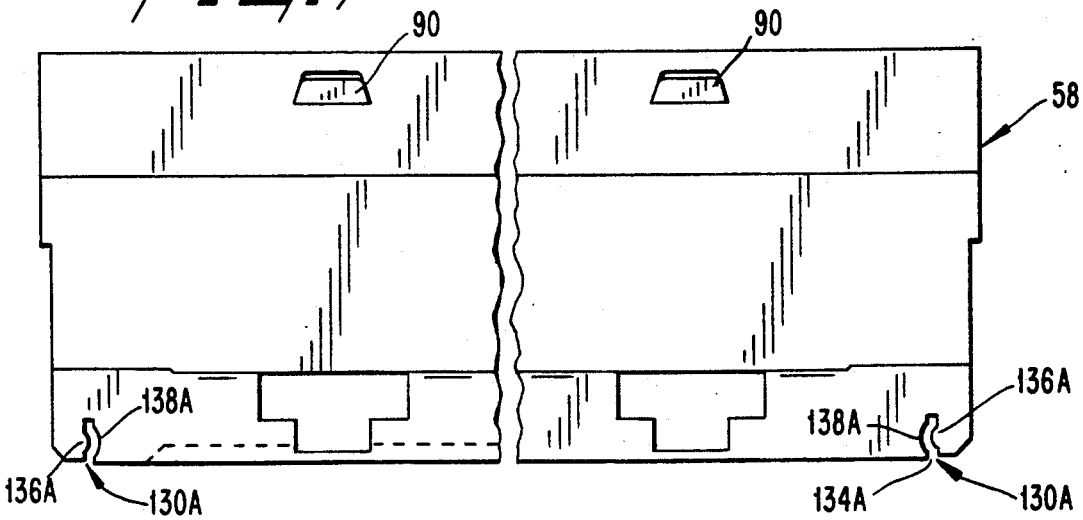

Fig. 8
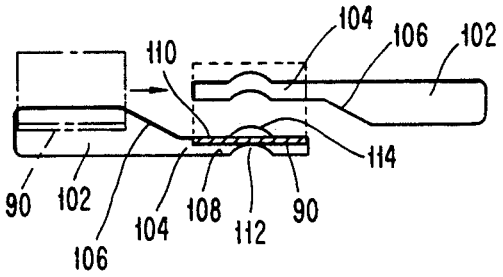
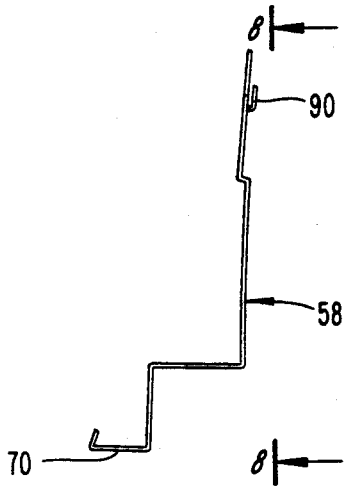
Fig. 9
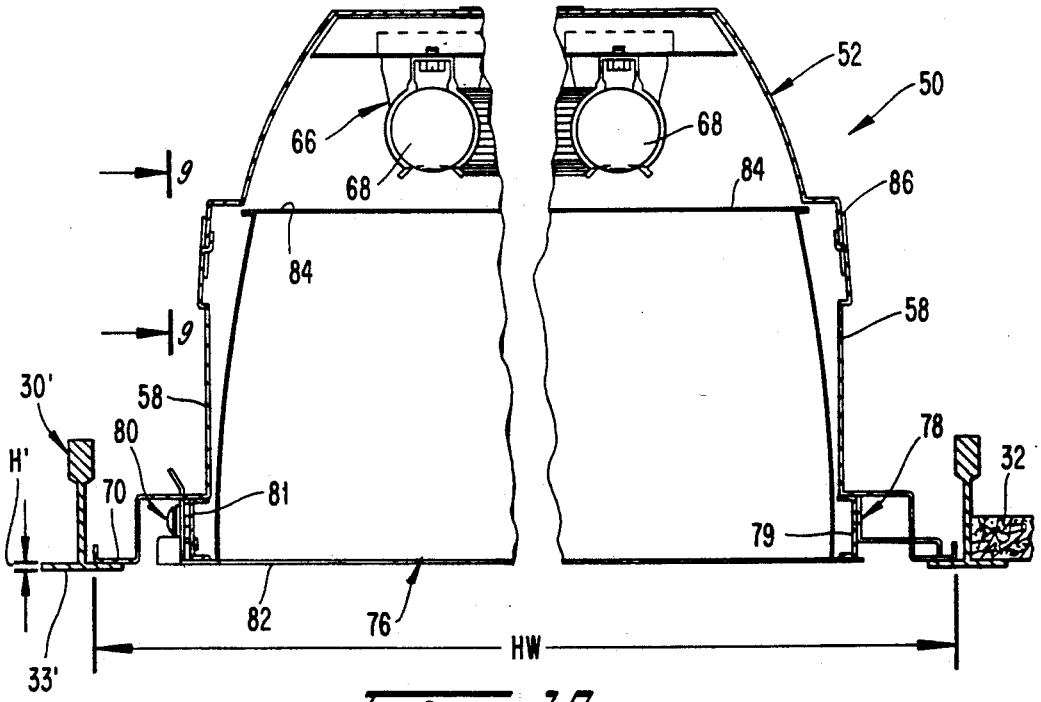
Fig. 10

LIGHTING FIXTURE FOR USE IN SUSPENDED CEILINGS

BACKGROUND OF THE INVENTION

The present invention relates to lighting fixtures of the type mounted in suspended ceilings and, in particular, to a housing structure of the fixtures.

A conventional lighting fixture adapted to be mounted in a suspended ceiling is depicted in FIGS. 11 and 2. That fixture 10 includes a metal housing 12 in which one or more fluorescent lamps 14 are mounted Also mounted in the housing is shielding media in the form of a deep cell parabolic louver assembly 16 for directing the emitted light in a desired fashion.

The housing 10 comprises two transverse end plates 18 (only one being shown in FIG. 1) which are suitably affixed (e.g., by bolts or rivets) to the central housing section 20. Each end plate includes a lower transverse support flange 17 forming a downwardly facing transverse surface 21. The central housing part 20 includes a pair of longitudinal walls 22 which include bottom support flanges 23 forming downwardly facing, longitudinal surfaces 24. The fixture 10 is installed within a suspended ceiling 28 (see FIG. 2) which comprises horizontal grid members 30 that support ceiling tiles 32. The surfaces 21, 24 of the bottom flanges are seated upon bearing surfaces formed by horizontal legs 33 of the grid members 30.

It is highly desirable that the fixture be installed such that the lower edge or aperture 40 of the louver assembly is nearly coplanar (i.e., flush) with the undersides 42 of the ceiling tiles. That goal is complicated by the fact that grid members of various sizes are commonly employed in the ceiling industry. For example, so-called "screw slot" grid members 30 depicted in FIGS. 2 and 12 have a leg height H of 0.312 inches, whereas so-called "standard" grid members 30', depicted in FIG. 11, have a leg height H, of 0.050 in. Therefore, it will be appreciated that a fixture in which the vertical relationship between the bottom surfaces 24 of the support flanges and the aperture 40 of the louver assembly is dimensioned so as to be compatible with one type of grid member, will not be compatible with the other type of grid member.

Attempting to deal with this problem by simply raising and lowering the louver assembly 16 within the housing is not satisfactory, because that changes the vertical focal/light center spacing between the lamp 14 and the louver assembly 16, and thus will adversely affect the photometric relationship between the lamp and the parabolic cells of the louver assembly. The provision of louver assemblies of different heights which can be interchanged in the housing to maintain a constant spacing S, will not solve the problem, because the difference in parabola heights will also adversely affect the photometric characteristics of the optical assembly.

Therefore, it would be desirable to provide a lighting fixture which can be easily and inexpensively adapted to different size grid members while maintaining a desired spacing between the lower edge of the shielding media and the lamp(s).

It would also be desirable to provide such a lighting fixture which can be adapted to different size grid members by the end user of the lighting fixture.

SUMMARY OF THE INVENTION

The present invention involves a convertible light fixture housing adapted to be converted for selective use in different suspended ceilings having grid members with bearing surfaces of a predetermined height differential. The housing comprises a main section and a pair of side sections. The main section includes a mechanism for supporting at least one lamp. The side sections include a mechanism for supporting shielding media. The side sections also include flanges which are configured to rest upon the bearing surfaces. Vertically spaced mounts releasably and adjustably secure the main section to the side sections to enable the main section to be vertically adjusted relative to the side sections by a predetermined vertical distance corresponding substantially to the height differential of the grid members.

Preferably, the mounting mechanism comprises tabs carried by one of the main section and the respective side sections, and slots formed in the other of the main section and the respective side sections. The slots include vertically spaced slots for selectively receiving the tabs in order to locate the side sections in selective vertical positions.

Each of the slots is preferably substantially longer than its respective tab, and includes a tab-receiving portion, a tab-positioning portion disposed horizontally adjacent the tab-receiving portion, and an inclined transition portion therebetween for guiding a tab from the tab-receiving portion to the tab-positioning portion. The tab-receiving portion is vertically wider than the tab-positioning portion to facilitate the insertion of a tab therein.

Preferably, the tab-positioning portion includes two vertically spaced surfaces between which a tab is received. One of those surfaces includes a projection, and the other of the surfaces includes a recess disposed directly opposite the projection. A spacing between the projection and the plane of the other surface is substantially equal to the thickness of the tab received therein.

BRIEF DESCRIPTION OF THE DRAWINGS

The objects and advantages of the invention will "-become apparent from the following detailed description of a preferred embodiment thereof in connection with the accompanying drawings in which like numerals designate like elements, and in which:

FIG. 5 is an enlarged fragmentary perspective view of the portion of the housing depicted in FIG. 4 after the side and end sections of the housing have been brought together;

FIG. 6 is a side elevational view of a main housing section according to the present invention;

FIG. 7 is a side elevational view of a frame side section according to the present invention;

FIG. 8 is an enlarged view of an associated pair of slots formed in the frame main section as viewed in a direction taken along the line 8—8 in FIG. 10;

FIG. 9 is a side elevational view of the frame side section depicted in FIG. 7;

FIG. 10 is a schematic cross-sectional view taken through a light fixture housing according to the present invention, wherein the frame side sections are mounted in a lower row of slots of the housing main section, and the fixture is seated on ceiling grid members of a first type;

DETAILED DESCRIPTION OF A PREFERRED EMBODIMENT OF THE INVENTION

Figure 1:
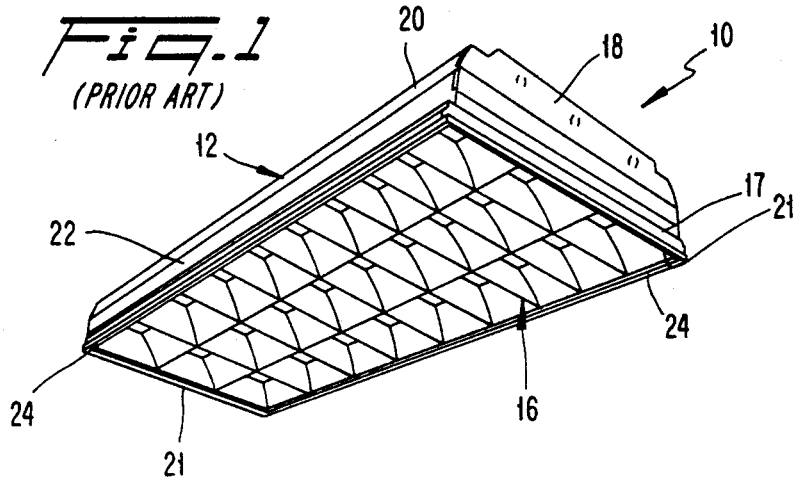
Fig. 1 (PRIOR ART)
FIG. 1 is a bottom perspective view of a conventional lighting fixture.
Figure 2:
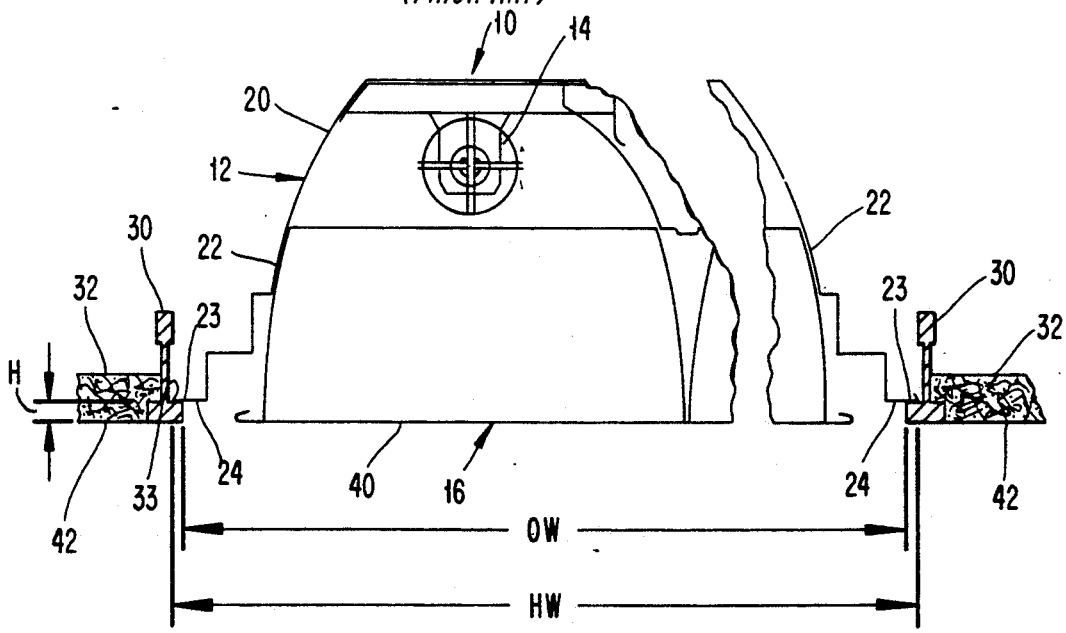
Fig. 2 (PRIOR ART)
FIG. 2 is a schematic cross-sectional view of the lighting fixture of FIG. 1 mounted in a suspended ceiling.
Figure 3:
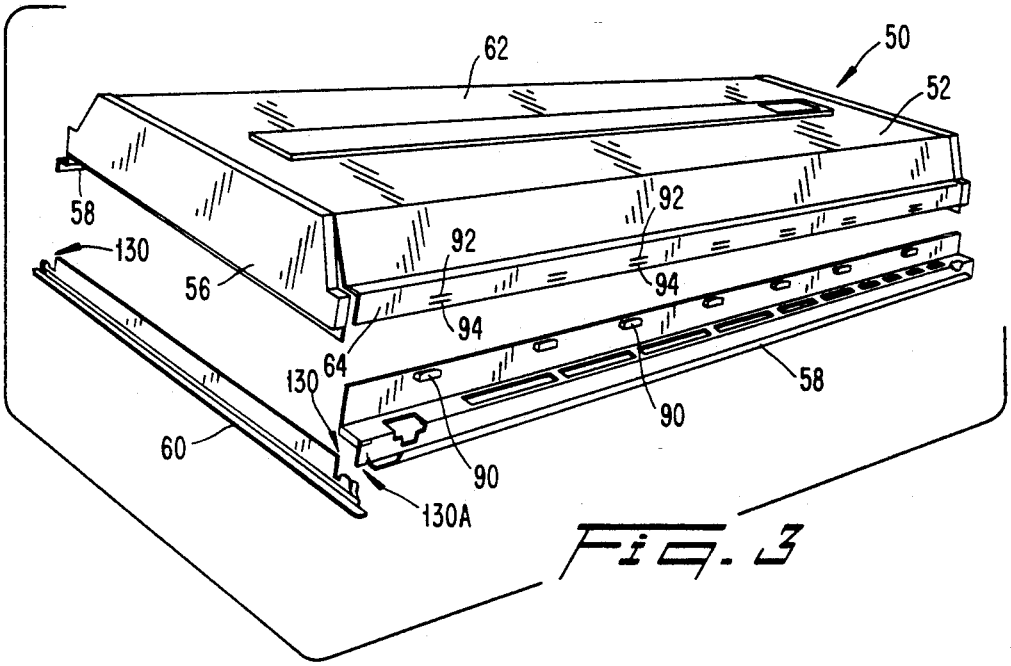
FIG. 3 is a schematic exploded perspective view of a lighting fixture housing according to the present invention.
Figure 4:
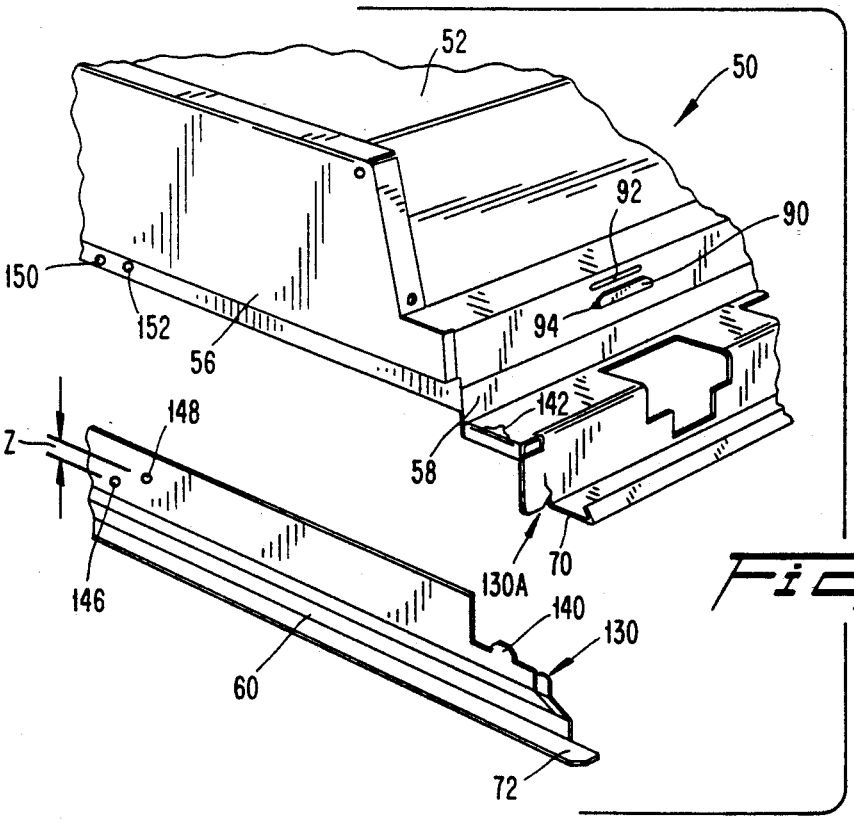
FIG. 4 is an enlarged fragmentary exploded perspective view of the housing depicted in FIG. 3.

A light fixture 50 according to the present invention is depicted schematically in FIGS. 3-5. The light fixture 50 comprises a housing 52 formed of a main section 54, a pair of end plates 56 (only one being depicted), a pair of longitudinal side sections 58, and a pair of transverse end sections 60 (only one being depicted). The main section 52 includes a horizontal top wall 62, and a pair of depending side walls 64 extending along opposite longitudinal sides. The top wall 62 carries one or more conventional devices 66 for supporting a fluorescent lamp 68 within a lamp cavity formed by the main section (see FIG. 10). Each of the side sections 58 includes a side flange 70 extending along its lower periphery, and each of the end sections 60 includes an end flange 72 extending along its lower periphery.

Mounted within the housing is a shielding medium, such as a deep cell parabolic louver assembly 76. Alternatively, the shielding medium could comprise a "luminous element" in the form of a low brightless prismatic lens which extends across the open lower end of the housing. One side of the louver assembly 76 includes a frame member 79 which is attached to a safety "T" hinge 78 carried by the housing to enable an opposite side of the louver assembly to swing up and down. That other side of the louver assembly includes a frame 8 which is releasably attached to the housing by means of a spring loaded cam latch 80.

The lighting fixture 50 is depicted in FIG. 10 as being seated on the bearing surfaces of standard type grid members 30' whose legs 33' have a height H, of 0.050 inches. The lower edge 82 of the louver assembly 76 is essentially coplanar with the undersides 33' of the grid members 30'.

Figure 11:
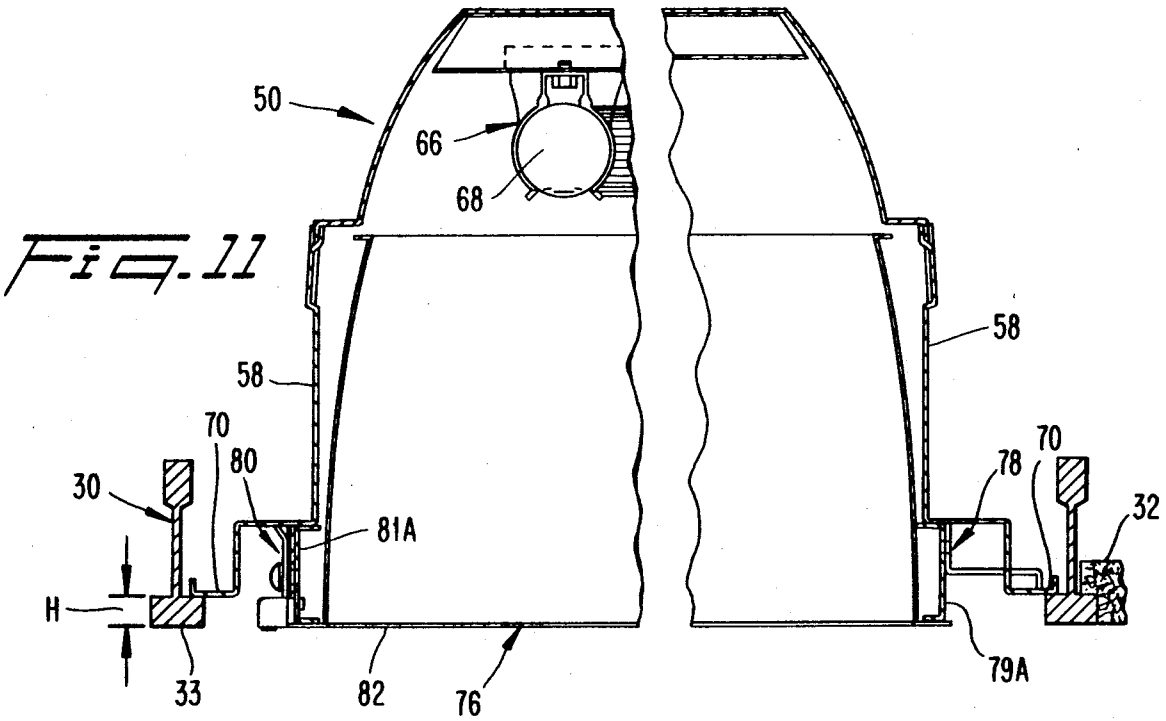
FIG. 11 is a view similar to FIG. 10 with the frame side sections mounted in an upper row of slots in the housing main section, and with the fixture seated on ceiling grid members of a second type.

FIG. 11 depicts the lighting fixture 50 mounted on a slotted type of grid member 30 whose leg height H is 0.312 inches. The lower edge 82 of the louver assembly is kept substantially parallel to the undersides 33 of the grid members 30 and the ceiling tiles. This is achieved by providing the louver assembly 76 with frame members 79A and 81A of greater height than the frame members 79, 81.

It will be appreciated that by providing the louver assembly 76 with the taller frame members 79A, 81A, the louver assembly 76 is caused to be aligned relative to the flanges 70, 72. In a typical prior art housing, the result would be that the vertical spacing between the lamp 68 and the louver assembly 76 would be increased, thereby adversely affecting the photometric relationship therebetween. However, in order to maintain the same spacing regardless of which frame members are employed, the present invention provides a vertical adjustment between the main section 52 and side sections 58 of the housing. In that regard, each side section 58 includes a plurality of formed-out tabs 90, as depicted in FIGS. 3 and 4. Those tabs 90 are configured to be selectively insertable into slots 92, 94 formed in the main section 52. The slots comprise an upper row of horizontally spaced slots 92, and a lower row of horizontally spaced slots 94. A vertical spacing between the rows of slots corresponds substantially to the height differential between the bearing surfaces of grid members 30 and 30'.

As a result, the main section 52 (along with the lamp 68) can be raised and lowered relative to the side sections 58. By dimensioning the vertical distance between the upper and lower rows of slots in accordance with the differential between the leg heights of the grid members 30 and 30', the spacing between the lamp 68 and the louver assembly 76 can be kept substantially constant by shifting the tabs to a different row of slots when the lighting fixture is mounted on a different type of grid member. Consequently, the photometric relationship between the lamp and shielding media is kept constant.

If desired, more than two rows of slots could be provided, in order to enable the housing to be adaptable to additional sizes of grid members.

Depicted in FIGS. 6 and 8 are preferred configurations of the upper and lower slots 100, 116. The upper slots 100 partially overlap the lower slots 116 horizontally. Each slot 100, 166 includes a tab-receiving portion 102, a tab-positioning portion 104, and an inclined transition portion 106 extending therebetween. The tab-receiving portion is wider in the vertical direction than the tab-positioning portion, whereby a tab 90 can be easily inserted into the tab-receiving portion 102 (see FIG. 8), By then sliding the side flange 58 horizontally toward the tab positioning portion, the inclined transition portion 106 guides the tab into the tab-positioning portion 104.

The tab-positioning portion of each slot includes a lower surface 108 and an opposing upper surface 110 spaced therefrom. The lower surface 108 includes a rounded projection 112, and the upper surface 113 includes a recess 114 situated directly opposite the projection. Such a slot configuration ensures that the effective width of the slot, as defined by the vertical distance X (see FIG. 6) between the tip of the projection and the plane of the opposing surface 110, can be manufactured to very close tolerances. By making that slot width substantially equal to the thickness of the tab 90, it is ensured that the tab can be snugly seated within the slot with no appreciable "play" or looseness. Hence, the spacing between the lamp 68 and the louver assembly 76 can be held within close tolerances.

The tab-positioning portion of the lower slot 116 is aligned vertically below that of the upper slot. As a result, after being installed in the main section 52, the side section 58 will be situated in the same horizontal position relative to the main section 52, regardless of which row of slots receive the tabs.

The vertical distance between the centerlines of the upper and lower slots 100, 116 corresponds substantially to the difference in the heights H, H' of the legs of the grid members, as noted earlier, whereby the housing is compatible with those two types of grid members.

In order to enhance the securement between the side sections 58 and the main section 52, fasteners such as screws, can be inserted through those sections.

Figure 12:
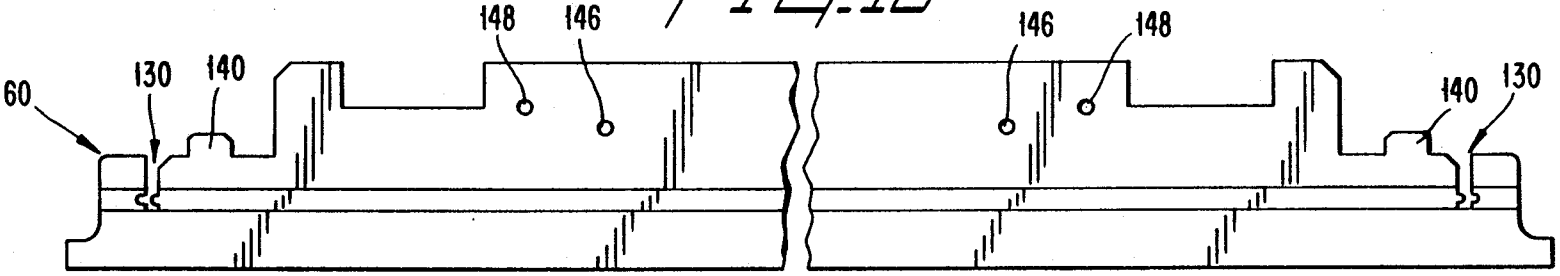
FIG. 12 is a side elevational view of a transverse end section of the housing frame according to the present invention.

Each of the end sections 60 includes slots 130 at both ends thereof (see FIGS. 5 and 12). Likewise, each of the side sections 58 includes slots 130A at both ends thereof (see FIGS. 4 and 7). Each slot 130A is configured similarly to the slots 130. When the end sections 50 are joined to the side sections 58, the slots 130 and 130A are mutually engaged (see FIG. 5). The end sections 60 thus positively retain and locate the outer edges of the side sections 58.

Each end section 60 includes vertical lugs 140 which are received within slots 142 formed in the side sections 58 in order to aid in locating the end sections 60 and side sections 60 relative to one another. Each end section 60 includes first and second horizontally spaced holes 146, 148 (see FIG. 6) which are located at the same elevation. Each end plate 56 includes third and fourth holes 150, 152 which are spaced horizontally by the same distance as the holes 146, 148. However, the holes 150, 152 in the end plate are vertically spaced by a distance Z which corresponds to the vertical spacing between the upper and lower slots 100, 116. Therefore, when the tabs 90 are disposed in the tab-positioning portions 104 of the upper slots 100, the holes 146, 150 will be aligned for receiving a fastener, and when the tabs are disposed in the tab-positioning portions of the lower slots 116, the holes 148, 152 will be aligned for receiving a fastener.

It will be appreciated that a lighting fixture according to the present invention can be easily adapted for use with a plurality of different grid members 30, 30', i.e., grid members having a predetermined height differential. That is, it is merely necessary to provide the louver assembly 76 with different (i.e., taller or shorter) frame members 79, 81 (see FIG. 10), and insert the tabs 90 of the side sections 58 into the appropriate row of slots 100, 116 in the frame main section 52. Thus, it is possible to locate the lower edge 82 of the louver assembly 76 essentially flush with the undersides of the ceiling tiles without changing the spacing S between the lamp 68 and the louver assembly 76, and without having to change the height of the louver assembly itself. That adjustment can be made easily, even by maintenance or construction personnel at the building site.

Although the preferred embodiment of the invention has been disclosed in connection with a shielding medium in the form of a louver assembly 76, the invention is equally applicable to lighting fixtures employing different types of shielding media, such as luminous element (lenses), for example, which extend horizontally across the bottom, open end of the housing. That is, the invention enables the lower surface or edge of such a lens to be located substantially flush with the undersides of the ceiling tiles.

Although the present invention has been described in connection with a preferred embodiment thereof, it will be appreciated by those skilled in the art that additions, deletions, modifications and substitutions may be made without departing from the spirit and scope of the as defined in the appended claims.

What is claimed is:

1. A light fixture housing adapted to be converted for selective use in different suspended ceilings having grid members with bearing surfaces of a predetermined height differential, said housing comprising a main section and a pair of side sections; said main section including means for supporting at least one lamp; said side sections including means for supporting shielding media, and also including flanges configured to rest upon said bearing surfaces; and vertically spaced mounting means releasably and adjustably securing said main section to said side sections to enable said main section to be vertically adjusted relative to said side sections by a predetermined vertical distance corresponding substantially to said predetermined height differential.

2. A convertible light fixture housing according to claim 1, wherein said mounting means comprises tab means carried by one of said main section and respective side sections, and slot means formed in the other of said main section and respective side sections.

3. A convertible light fixture according to claim 2, wherein said slot means includes vertically spaced slots for selectively receiving said tab means to locate said side sections in selected vertical positions, said slots being vertically spaced by said predetermined vertical distance.

4. A convertible light fixture housing according to claim 3, wherein said tab means is carried by said respective side sections, and said slots are carried by said main section.

5. A convertible light fixture housing according to claim 4, wherein said vertically spaced slots comprise a first row of horizontally spaced slots and a second row of horizontally spaced slots, said slots of said second row being situated higher than respective slots of said first row.

6. A convertible light fixture housing according to claim 2, wherein each of said slots is substantially longer than its respective tab, and includes a tab-receiving portion, a tab-positioning portion disposed horizontally adjacent said tab-receiving portion, and an inclined transition portion therebetween for guiding a tab from said tab-receiving portion to said tab-positioning portion, said tab-receiving portion being vertically wider than said tab-positioning portion.

7. A convertible light fixture housing according to claim 6, wherein each of said upper slots has its tab-positioning portion situated directly above a tab-positioning portion of an associated lower slot.

8. A convertible light fixture housing according to claim 7, wherein said tab-receiving portions of respective upper and lower slots extend in opposite horizontal directions from their respective tab-positioning portions.

9. A convertible light fixture housing according to claim 1 including a pair of end plates attached to respective longitudinal ends of said main section, and a pair of transverse end sections attached to lower portions of respective end plates, each of said transverse end sections and its associated end plate having holes aligned with one another when said main section is in each of its vertical positions of adjustment, and fasteners insertable into said aligned holes.

10. A convertible light fixture adapted to be converted for selective use in different suspended ceilings having grid members with bearing surfaces of a predetermined height differential, said fixture comprising:

a housing main section including first and second downwardly extending portions, each of said downwardly extending portions including vertically spaced rows of slots, said rows being vertically spaced by a predetermined distance corresponding substantially to said predetermined height differential, at least one lamp mounted to said main section between sad downwardly extending portions, a pair of housing side sections attached to lower longitudinal edges formed by said downwardly extending portions, and flanges configured to rest upon said bearing surfaces, shielding media mounted to said side sections so as to be situated beneath said lamp, and each of said side sections including a row of horizontally spaced tabs arranged to be removably received in one of said rows of slots so that said main section and said lamp can be adjusted vertically relative to said side sections and said shielding media.

11. A convertible light fixture according to claim 10, wherein said at least one lamp comprises a fluorescent lamp.

12. A convertible light fixture according to claim 10, wherein said shielding media comprise a deep cell parabolic louver assembly.

13. A convertible light fixture according to claim 10, wherein said shielding media comprises a translucent cover.

14. A convertible light fixture according to claim 10, wherein each of said slots is substantially longer than its respective tab, and includes a tab-receiving portion, a tab-positioning portion disposed horizontally adjacent said tab-receiving portion, and an inclined transition portion therebetween for guiding a tab from said tab-receiving portion to said tab-positioning portion, said tab-receiving portion being vertically wider than said tab-positioning portion.

15. A convertible light fixture housing according to claim 14, wherein each of said upper slots has its tab-positioning portion situated directly above a tab-positioning portion of an associated lower slot.

16. A convertible light fixture housing according to claim 14, wherein said tab-receiving portions of said respective upper and lower slots extend in opposite horizontal directions from their respective tab-positioning portions.

* * * * *